US007833141B2

(12) United States Patent
Kulka

(10) Patent No.: US 7,833,141 B2
(45) Date of Patent: Nov. 16, 2010

(54) EXERCISE APPARATUS AND METHODS

(75) Inventor: Matthew Kulka, Newtown, PA (US)

(73) Assignee: J & M Medical Sales, LLC, Langhorne, PA (US)

( * ) Notice: Subject to any disclaimer, the term of this patent is extended or adjusted under 35 U.S.C. 154(b) by 97 days.

(21) Appl. No.: 12/115,276

(22) Filed: May 5, 2008

(65) Prior Publication Data

US 2009/0192022 A1 Jul. 30, 2009

Related U.S. Application Data

(60) Provisional application No. 61/024,131, filed on Jan. 28, 2008.

(51) Int. Cl.
*A63B 21/00* (2006.01)

(52) U.S. Cl. ..... 482/127; 482/126; 482/121

(58) Field of Classification Search ..... 482/121, 482/126, 127, 907
See application file for complete search history.

(56) References Cited

U.S. PATENT DOCUMENTS

| | | | | | |
|---|---|---|---|---|---|
| 1,416,741 | A | * | 5/1922 | Nicholls et al. | 428/129 |
| 3,451,271 | A | | 6/1969 | Knoblauch | |
| 4,273,327 | A | | 6/1981 | Nall et al. | |
| D264,237 | S | * | 5/1982 | McCaleb et al. | D21/680 |
| 4,351,527 | A | | 9/1982 | Crisp, Jr. | |
| 4,371,162 | A | | 2/1983 | Hartzell | |
| 4,376,532 | A | | 3/1983 | Hunstad | |
| 4,438,920 | A | * | 3/1984 | Veillette | 482/46 |
| 4,478,413 | A | | 10/1984 | Siwula | |
| 4,659,077 | A | | 4/1987 | Stropkay | |
| 4,787,630 | A | | 11/1988 | Watson et al. | |
| 4,863,163 | A | | 9/1989 | Wehrell | |
| 4,911,438 | A | | 3/1990 | Van Straaten | |
| 5,312,309 | A | * | 5/1994 | Fox | 482/45 |
| 5,505,681 | A | * | 4/1996 | Bruggemann | 482/127 |
| 5,512,029 | A | | 4/1996 | Barnard et al. | |
| 5,551,934 | A | | 9/1996 | Binette | |
| 5,679,105 | A | | 10/1997 | Vittone et al. | |
| 5,755,648 | A | * | 5/1998 | Kildani | 482/121 |
| 5,795,277 | A | | 8/1998 | Bruntmyer | |
| 5,860,897 | A | | 1/1999 | Gilbert et al. | |
| 5,882,284 | A | | 3/1999 | Cayne | |
| 6,004,248 | A | | 12/1999 | Price | |
| 6,120,418 | A | | 9/2000 | Plough | |
| 6,151,758 | A | * | 11/2000 | Chiu | 16/443 |
| 6,220,994 | B1 | | 4/2001 | Rich | |
| 6,299,569 | B1 | | 10/2001 | Rich | |
| 6,338,700 | B1 | | 1/2002 | Pollock | |
| 6,402,667 | B1 | | 6/2002 | Dahn | |
| 6,402,669 | B1 | | 6/2002 | Olstad | |
| 6,405,683 | B1 | | 6/2002 | Walter et al. | |
| 6,425,844 | B1 | | 7/2002 | Azar | |
| 6,461,285 | B1 | | 10/2002 | Theunissen et al. | |
| 6,558,301 | B1 | | 5/2003 | Jackson | |
| 6,689,025 | B2 | | 2/2004 | Emick | |
| 6,746,372 | B2 | | 6/2004 | Hsu | |

(Continued)

*Primary Examiner*—Jerome Donnelly
(74) *Attorney, Agent, or Firm*—Panitch Schwarze Belisario & Nadel LLP

(57) ABSTRACT

The present embodiments relate to an exercise device that can provide for a novel and versatile method of exercising. The exercise apparatus can be provided with a base, a connector, and a bar for spooling the connector on the bar. The exercise apparatus can be used for both stretching and strength training exercises.

20 Claims, 9 Drawing Sheets

U.S. PATENT DOCUMENTS

| | | | |
|---|---|---|---|
| 6,792,893 | B1 | 9/2004 | Quintero et al. |
| 6,835,168 | B2 | 12/2004 | Huang |
| 6,921,355 | B2 | 7/2005 | Campanaro et al. |
| 6,926,650 | B2 | 8/2005 | Endelman et al. |
| 7,112,168 | B2 | 9/2006 | Dalebout et al. |
| 7,217,227 | B2 | 5/2007 | Finn |
| 7,250,021 | B2 | 7/2007 | Leight |
| 2002/0077231 | A1 | 6/2002 | Dalebout et al. |
| 2002/0123415 | A1 | 9/2002 | Marques |
| 2003/0158021 | A1 | 8/2003 | Prichard |
| 2005/0059536 | A1 | 3/2005 | Croft |
| 2005/0130814 | A1 | 6/2005 | Nitta et al. |
| 2005/0227828 | A1 | 10/2005 | Wu |
| 2006/0194680 | A1 | 8/2006 | Croft |
| 2007/0087920 | A1 | 4/2007 | Dachraoui et al. |

* cited by examiner

EXERCISE APPARATUS AND METHODS

CROSS REFERENCE TO RELATED APPLICATIONS

The present application claims the benefit of U.S. Provisional Patent Application No. 61/024,131, filed Jan. 28, 2008, entitled "Hamstring, back, and abdominal stretching & strengthening device" the entire disclosure of which is hereby incorporated herein by reference.

BACKGROUND OF THE INVENTION

The present invention relates to an exercise device and methods of using it. In particular, the present invention relates to an exercise device that can facilitate the stretching and strengthening of muscles.

Currently, there is a large variety of exercise equipment commercially available to the general public. However, such equipment is typically large and complex or designed for a specific function or a limited number of exercises. Moreover, individuals are typically not motivated to exercise or reluctant to exercise due to the amount of time or money required to join a gym or buy exercise equipment. As such, there is still a need for an exercise apparatus that is both versatile and which can be conveniently stored, is readily transportable, and affordable.

BRIEF SUMMARY OF THE INVENTION

In one embodiment, the present invention relates to an exercise apparatus comprising: a base; a bar that includes a spool; and a connector connecting the bar to the base.

In another embodiment, the present invention relates to a method of exercising comprising: providing to a user an exercise device that includes a base, a bar having a spool, and a connector connecting the bar to the base; bearing against the base with the user's feet; gripping the bar; and rotating the bar to spool the connector on the spool.

In yet another embodiment, the present invention relates to a method of exercising comprising: providing an exercise device that includes a base, a bar having a spool, and a connector connecting the bar to the base; securing the base to a user's feet; and gripping the bar.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
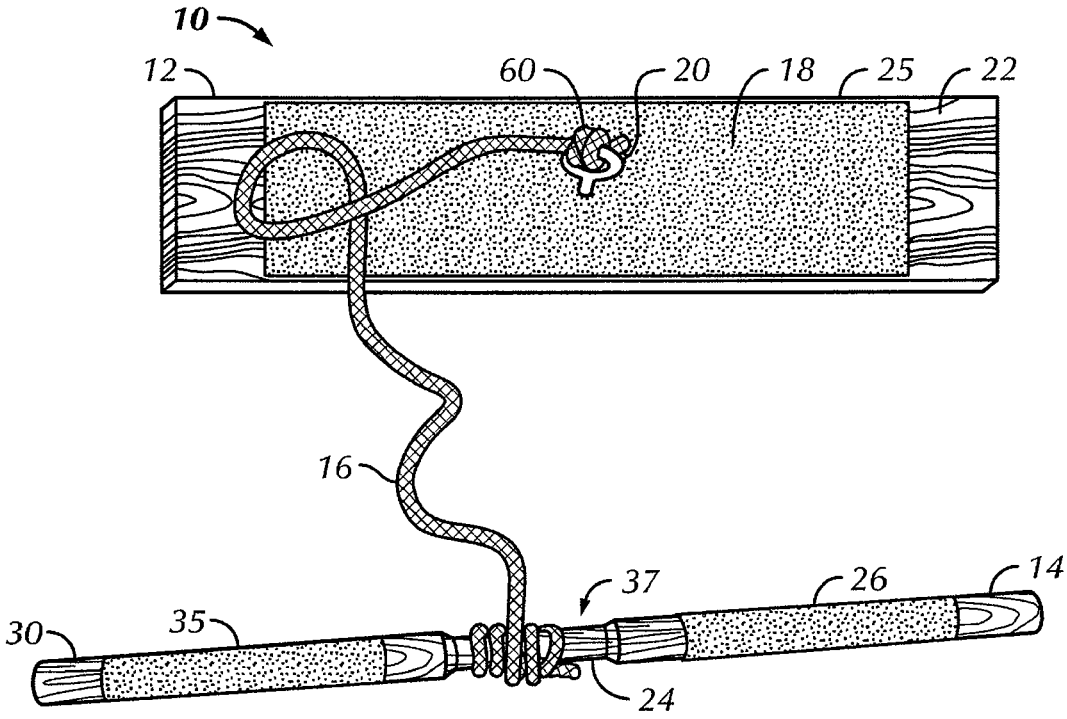
FIG. 1 is a perspective view of an exercise apparatus in accordance with a preferred embodiment of the present invention.

Certain terminology is used in the following description for convenience only and is not limiting. The words "front," "back," "side," "above," "top," "below," "bottom," "right," "left," "upper," and "lower" designate directions in the drawings to which reference is made, it being understood that in different orientations, the directions may be different than as shown. The terminology includes the words above specifically mentioned, derivatives thereof, and words of similar import.

In an embodiment, the present invention relates to an exercise apparatus 10 as shown in FIG. 1. The exercise apparatus 10 includes a base 12, a bar 14, and a connector 16. The connector 16 is connected to or connectable to the base 12 and the bar 14.

The base 12 is configured and sized such that it can support a user (i.e., a human being) and wherein a user can easily stand on the base 12 without losing balance, or the user can otherwise bear against the base 12 with the user's feet in a sitting or lying orientation other than standing. The base 12 can be made from any suitable material such as wood, plastics, metals, composites, or combinations thereof. Preferably, the base 12 includes a surface or surface finish to provide a non-slip surface. The non-slip surface can be provided by way of a covering 18 or a roughening of the base surface (not shown). The base 12 also includes a fastening member 20 connected to the top surface 22 of the base 12 for fastening the connector 16 thereto. Preferably, the fastening member 20 is connected to the base 12 about the center of the base 12, however, the fastening member 20 can be positioned anywhere along the top surface 22 of the base 12. The fastening member 20 may be as simple as an eye hook or any other type of member to which the connector 16 can be connected, including those set forth hereinafter in the foregoing embodiments.

The connector 16 has one end connected to the fastening member 20. The opposing end of the connector 16 is connected to the bar 14. The connector 16 may be connected directly to the fastening member 20 and the bar 14, such as by tying, clamping or other suitable type of connection. Alternatively, the connector 16 may be connected indirectly to the fastening member 20 and the bar 14 by a clip, snap, chain link or other type of intermediate mechanism, which facilitates a removable connection for interchanging types and/or lengths of connectors 16. A fastening member (not shown) is also preferably configured about the center of the bar 14 for connecting the connector 16 to the bar 14.

The connector 16 can be any flexible connector such as a rope, band, chain, strap, wire, or the like that is elastic or non-elastic, and combinations thereof. For example, the connector 16 can be an elastic band or cord between an inelastic connector, such as a rope, and the base 12, an elastic band or cord between an inelastic connector and the bar 14, or an elastic band or cord between inelastic connectors that are attached to the base 12 and bar 14. Clips or other similar devices can be used to removably connect the elastic and inelastic connectors to each other, the base 12, and the bar 14. The connector 16 is configured to be adjustable in length to accommodate users of varying height. In use, the connector should be approximately the length from about a user's hands to the floor such that a user standing on or bearing with his or her feet against the base 12 can easily grasp the bar 14.

Figure 2:
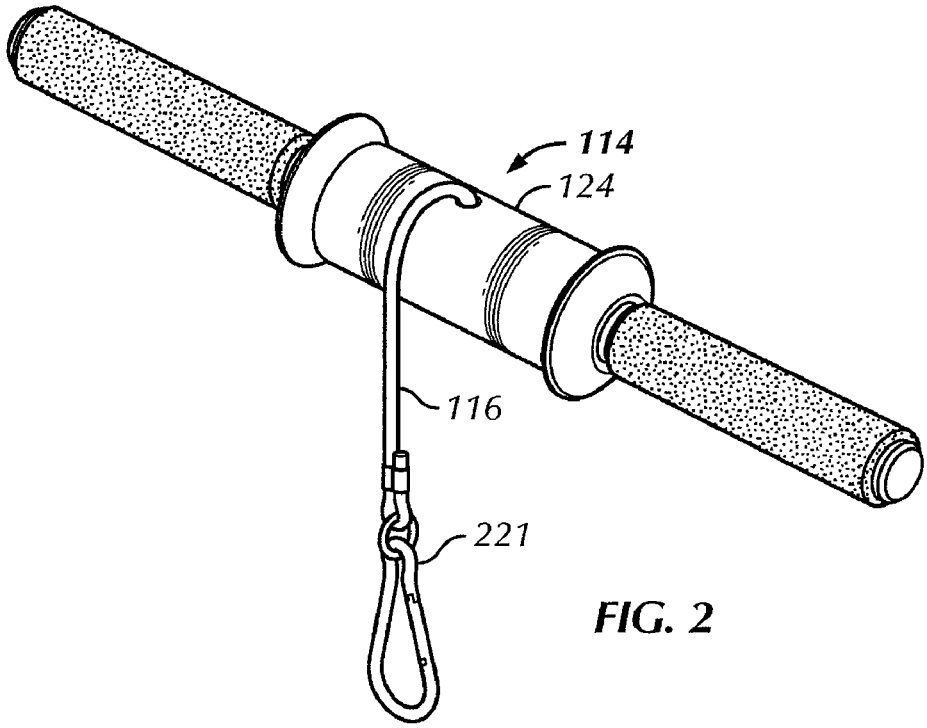
FIG. 2 is a perspective view of another embodiment of a bar of the exercise apparatus of FIG. 1.

The bar 14 is preferably configured as a cylindrical bar having a length approximately the same as the width of an average man or woman. However, the bar 14 can optionally be configured as a contoured bar (not shown). About the center of the bar 14, the bar 14 is configured with a spool 24. The spool 24 can be configured as an inset spool such that the diameter of the spool section is smaller than the overall diameter of the bar 14. Alternatively, the spool 24 can have a diameter larger than the overall diameter of the bar or be an external spool 124 as shown in FIG. 2. In general, the spool 24 is configured to allow a user to spool or wrap the connector 16 about the bar 14. The bar 14 can be made from any suitable material such as wood, plastics, metals, composites, or combinations thereof. The bar 14 can optionally be configured with a gripping surface 26, such as knurling, or with a gripping surface layer such as rubber, neoprene, plastic, metal, or the like.

Figures 3A, 3B:
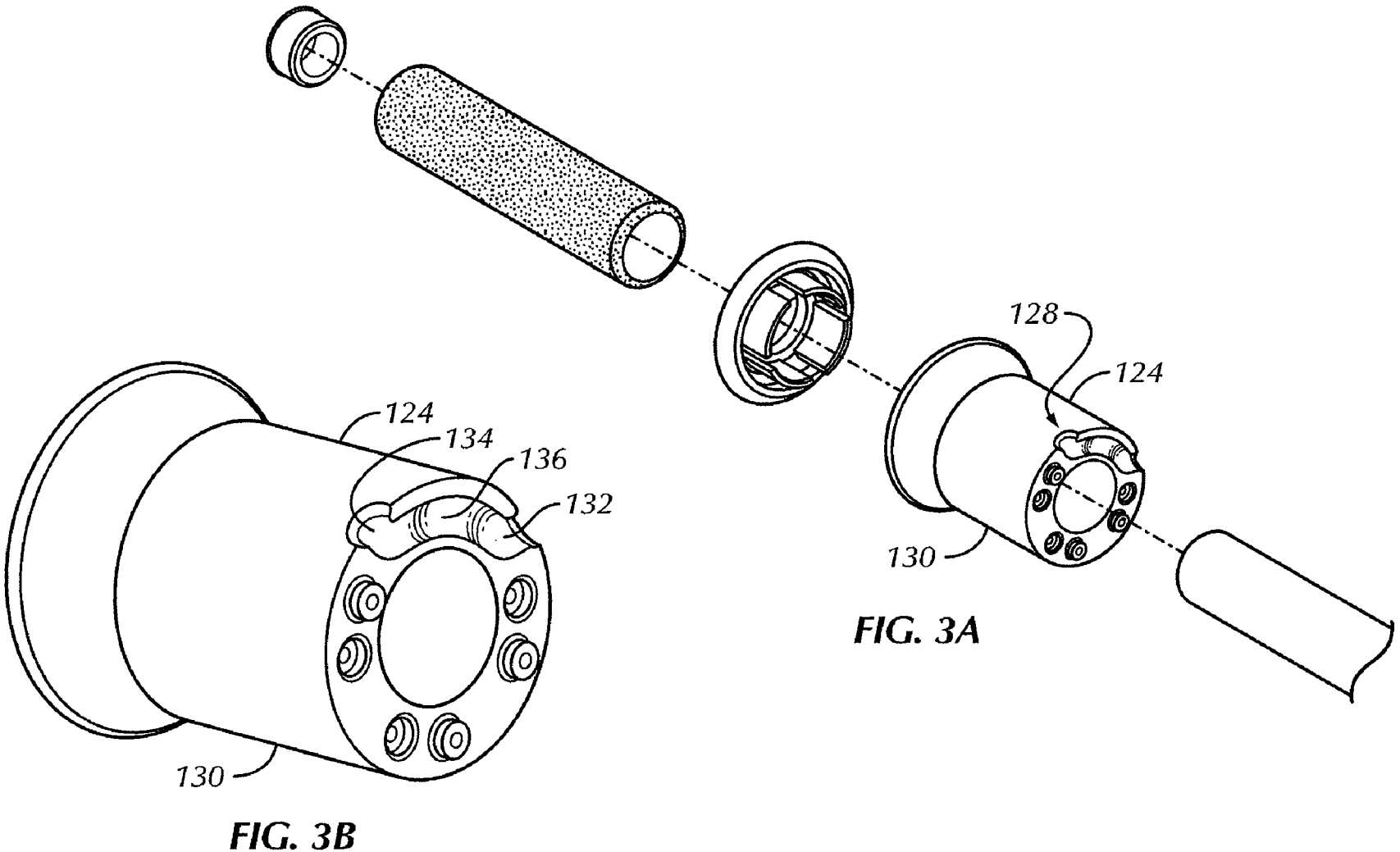
FIG. 3A is a perspective exploded view of the left half of the bar of FIG. 2.
FIG. 3B is an enlarged perspective view of the left half of the spool of the bar of FIG. 3A.

Referring to FIGS. 2 and 3, in another embodiment the present invention has a bar 114 that includes a spool 124. The spool 124, as best shown in FIGS. 3A and 3B, is configured with a left half 130 and a right half (not shown). The spool 124 includes a fastening member 128 to which the connector 116 can be directly or indirectly connected. Preferably, the fastening member 128 is formed by the assembly of the left half 130 and right half of the spool 124. The fastening member 128 includes a connector inlet 132, a connector outlet 134, and a connector channel 136. In one embodiment, the connector 116 can be attached to the fastening member 128 by threading the connector 116 through the connector inlet 132, connector channel 136, and out through the connector outlet 134, and then knotting the connector's end.

Figure 4:
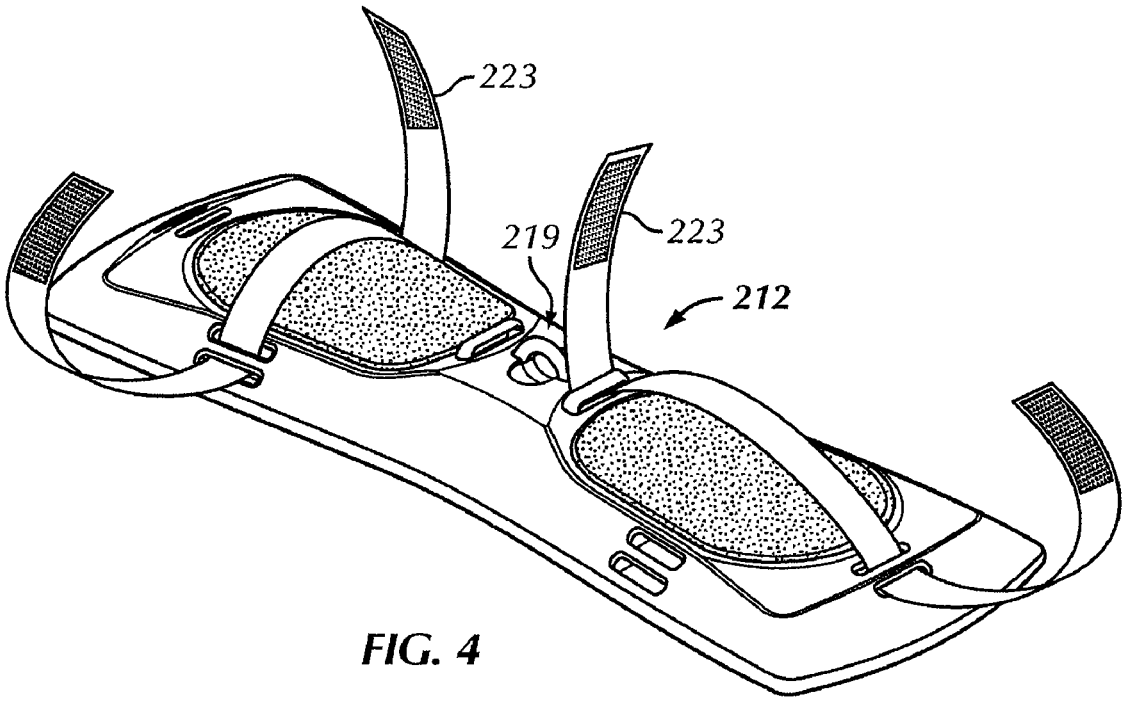
FIG. 4 is a perspective view of another embodiment of a base of the exercise apparatus of FIG. 1.
Figure 5:
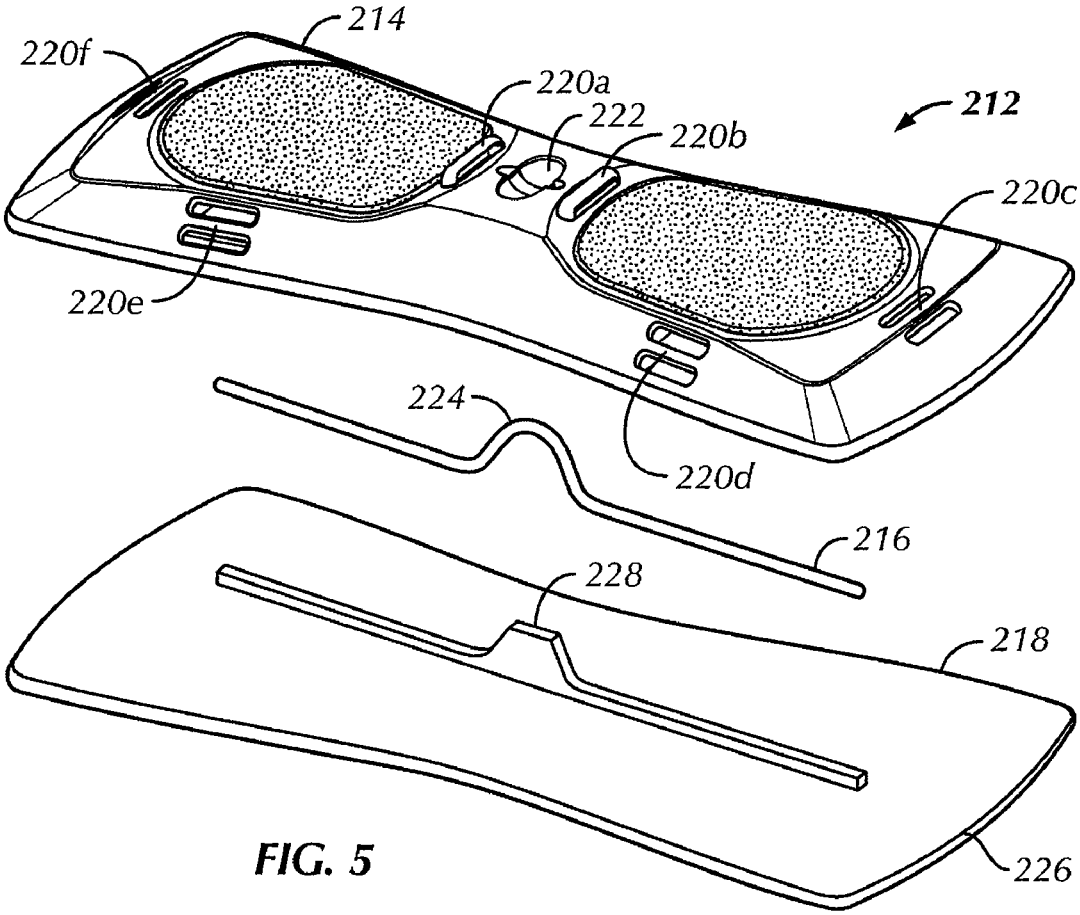
FIG. 5 is an exploded view of the base of FIG. 4.

Referring to FIGS. 4 and 5, the present embodiment also has a base 212 that includes a top plate 214, a support bar 216, and a bottom plate 218. The top plate 214 is generally contoured as shown in FIG. 5 such that a user can comfortably stand on it without losing his balance. The top plate 214 includes a connector retainer 219 for connecting with a connector (not shown). The connector can be tied to the connector retainer 219 or be connected to a clip 221 (as shown in FIG. 2) for easily connecting and disconnecting the connector to the connector retainer 219. The connector retainer 219 is configured about the center of the top plate 214 by the passage of the support bar's contoured center 224 through a through-hole 222.

The top plate 214 also includes a plurality (e.g., 8) of strap retainers 220*a-f* (only 6 shown for convenience) for connecting a user's feet or foot to the base 212 with straps 223. The straps 223 can be made from any durable fabric such as polyester, nylon or the like, which may overlap and be secured to themselves by hook and loop fasteners. The straps 223 can be threaded through or otherwise connected to the strap retainers 220*a-f*.

The support bar 216 is generally configured as shown in FIG. 5 with a contoured center 224. When assembled with the top plate 214 and bottom plate 218, the contoured center 224 protrudes through the top plate's 214 through-hole 222 to allow a user to fasten a connector thereto. The support bar 216 is preferably made from metal, but can be made from any material such as wood, plastics, metals, or metal alloys (such as steel, stainless steel, aluminum, aluminum alloys, etc.), composites, or combinations thereof that are suitable for its intended use.

The bottom plate 218 is generally configured with a planar base 226 and a support rib 228. The support rib 228 is configured to support the support bar 216 in the proper position within the base 212. The bottom plate 218 includes fasteners (not shown), such as snap-fits or the like, for fastening together the bottom plate 218 and the top plate 214.

Figure 6:
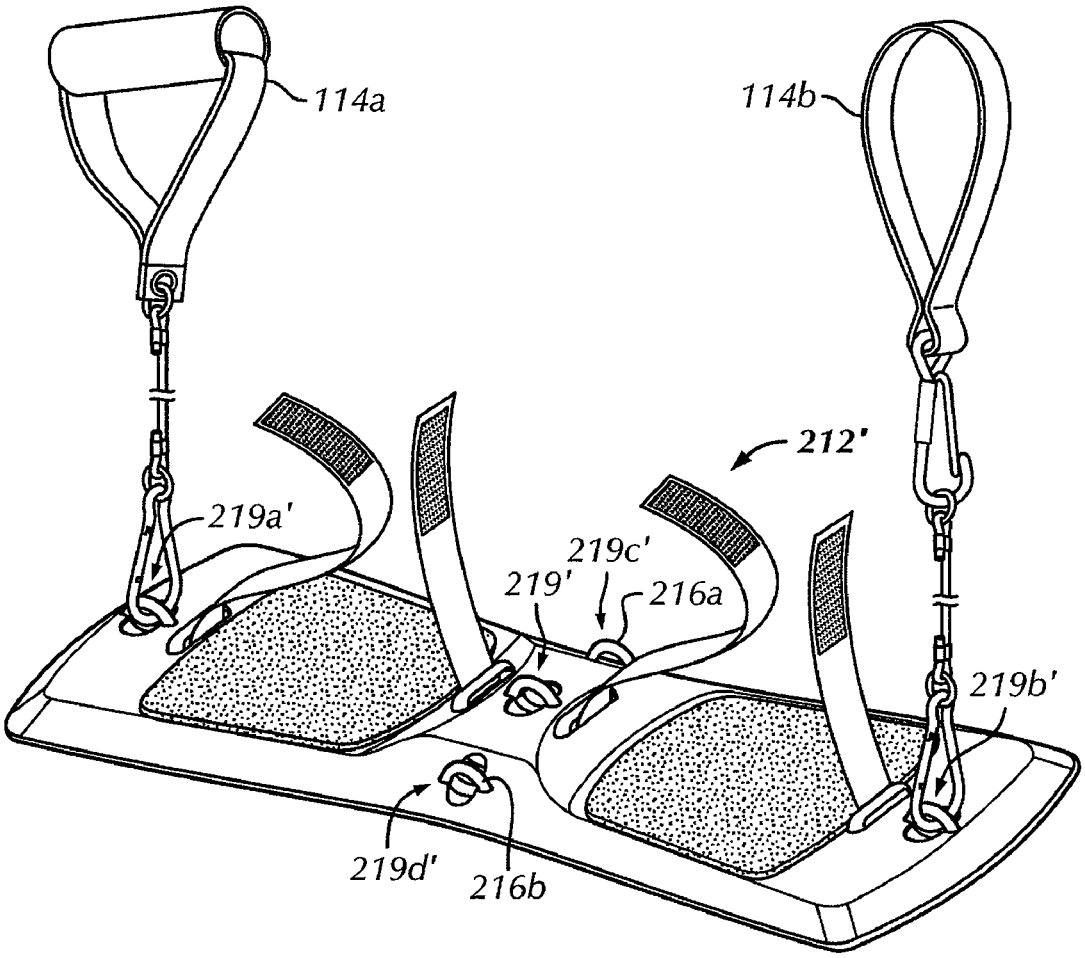
FIG. 6 is a perspective view of another embodiment of the base of FIG. 4.
Figure 7:
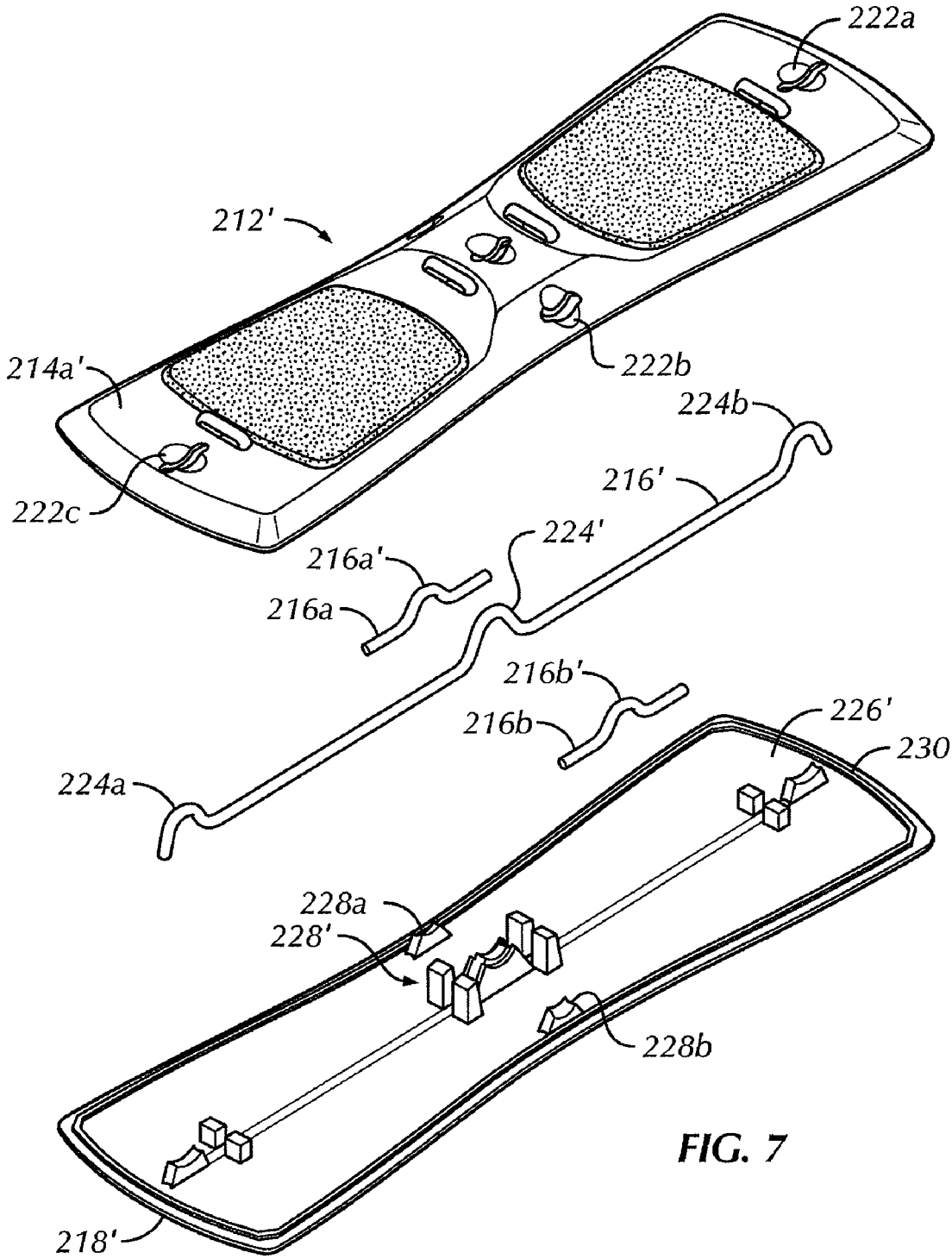
FIG. 7 is an exploded perspective view of the base of FIG. 6.

An alternative embodiment for the base 212 is shown in FIGS. 6 and 7. The base 212' is similar to that of base 212 except for the addition of secondary support bars 216*a* and 216*b*. The top plate 214' is generally contoured like top plate 214. Top plate 214' is also configured with four additional through-holes (only three through-holes 222*a-c* shown for convenience) for the passage of the secondary support bars 216*a* and 216*b* and additional contoured ends 224*a*, 224*b* of the support bar 216'.

The support bar 216' is generally configured as shown in FIG. 7 with a contoured center 224' and contoured ends 224*a*, 224*b*. The secondary support bars 216*a* and 216*b* are generally configured as shown in FIG. 7 with a contoured center 216*a'* and 216*b'*. When the top plate 212' and bottom plate 218' are assembled, the contoured centers 224', 224*a*, 224*b*, 216*a'*, and 216*b'* protrude through their respective through-holes on the top plate 212' to form connector retainers 219', 219*a'*, 219*b'*, 219*c'*, and 219*d'* respectively.

The plurality of connector retainers 219', 219*a'*, 219*b'*, 219*c'*, and 219*d'* allows a user to fasten one or more connectors 116 thereto. The connector 116 can be connected to the bar 114 or an individual hand grip 114*a* or ankle strap 114*b* as shown in FIG. 6.

The bottom plate 218' is generally configured with a planar base 226' and a support 228' generally configured as shown in FIG. 7 for supporting the support bar 216'. The bottom plate 218' also includes secondary supports 228*a*, 228*b*, generally configured as shown in FIG. 7, for supporting the secondary support bars 216*a* and 216*b* respectively. The bottom plate 218' also includes a snap-fit ridge 230 that is configured to match the outer profile of the top plate 212' for fastening the top plate 212' to the bottom plate 218'.

Figure 8:
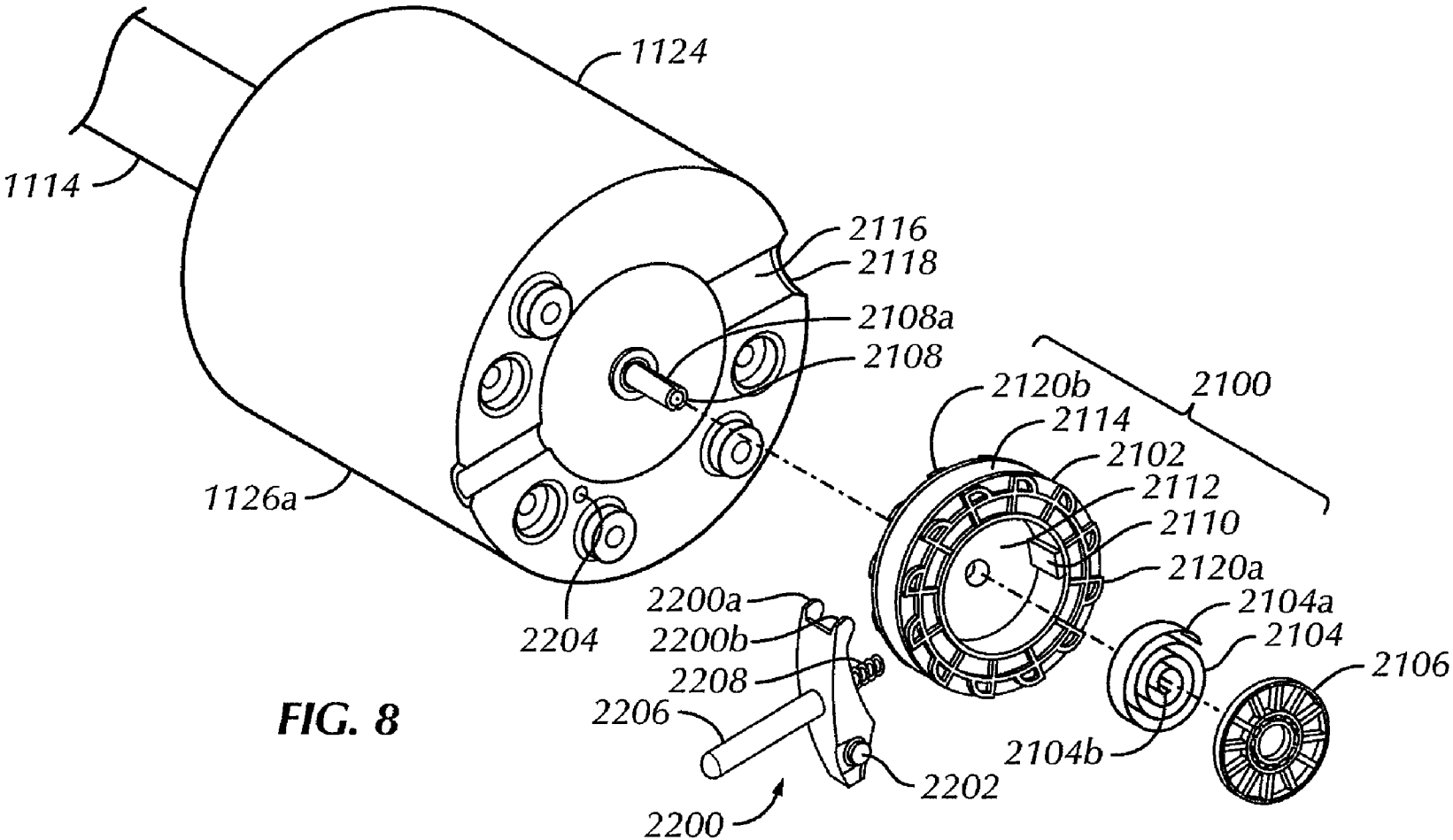
FIG. 8 is a perspective exploded view of yet another embodiment of the present invention showing a spool of the bar of FIG. 2 with an automatic retraction mechanism.
Figure 9:
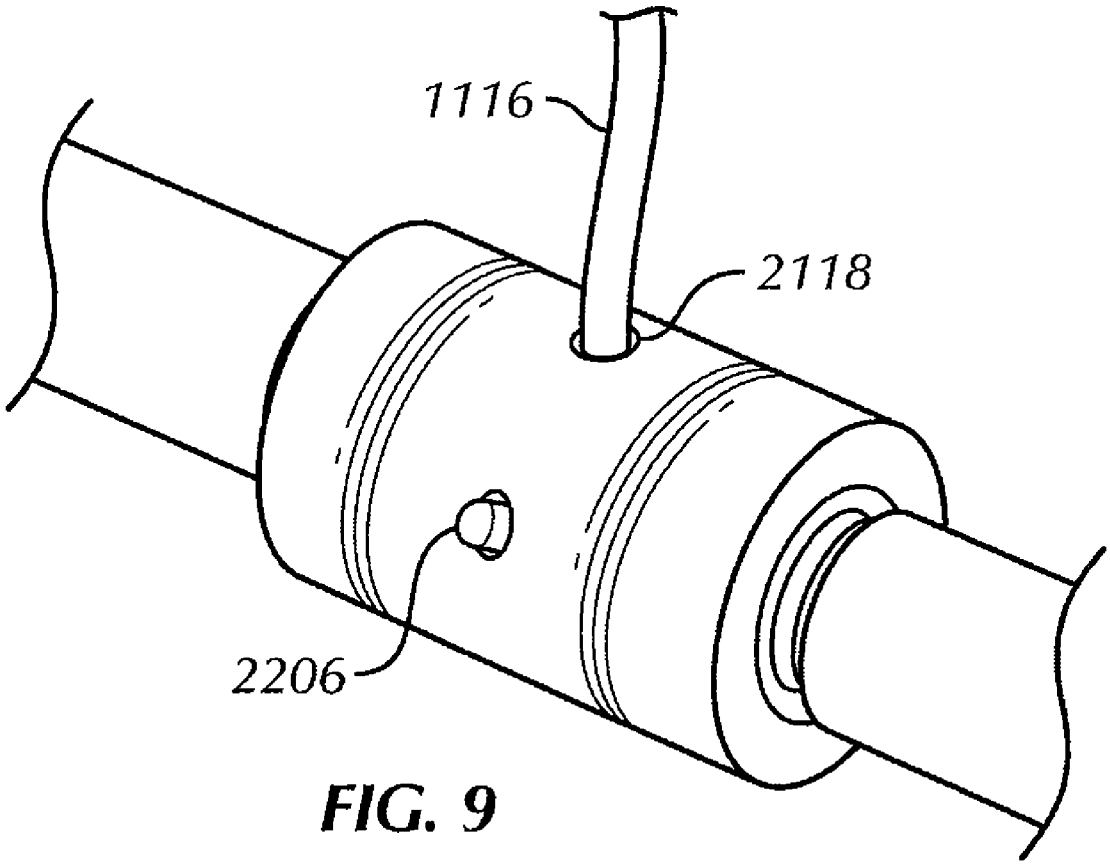
FIG. 9 is a perspective view of the bar of FIG. 8 in an assembled state.

In yet another embodiment, the present invention relates to a bar 1114 that includes a spool 1124 having a retractor and a trigger assembly 2200 as shown in FIGS. 8 and 9. The retractor includes an automatic spool assembly 2100 that is adapted for automatically winding the connector 1116. The spool assembly 2100 includes a rotatable reel 2102, a power spring 2104, and a reel cover 2106. A stationary axle 2108 extends from the spool housing half 1126*a*. A radially outer end 2104*a* of the power spring 2104 attaches to a retention element 2110 in the rotatable reel 2102 to fasten the power spring 2104 in the rotatable reel cavity 2112. The rotatable reel 2102 and the attached power spring 2104 fit onto the axle 2108. When mounted on the axle 2108, a radially inner end 2104*b* of the power spring 2104 fits into the slot 2108*a* of the axle 2108. In this way, the power spring 2104 is fastened at the radially outer end 2104*a* to the rotatable reel 2102, and at the radially inner end 2104*b* to the stationary axle 2108. The reel cover 2106 fastens over the power spring 2104 to secure the power spring 2104 in the rotatable reel cavity 2112. The power spring 2104 is initially coiled to spring bias the spool assembly 2100 to retract the connector 1116. Additionally, as the rotatable reel 2102 rotates to extend the connector 1116 out of the spool 1124, the power spring 2104 coils further, thereby providing additional retracting bias as the extended portion of the connector 1116 increases.

The outer surface 2114 of the rotatable reel 2102 is adapted for spooling the connector 1116. With the spool assembly 2100 mounted on the stationary axle 2108, and with the two spool housing halves, including left half 1126*a* and right half (not shown), fastened together, the inner surface 2116 of the spool housing half 1126*a* supports the connector 1116 as it winds around the surface 2114. A similar inner surface (not shown) of the spool housing's right half also supports the connector 1116 as it winds around the surface 2114.

The connector 1116 wound on the rotatable reel 2102 extends through an orifice 2118. An anti-wear ring or grommet (not shown) formed of a low friction material, such as polished stainless steel, nylon, polytetrafluoroethylene or the like, to reduce frictional wear on the connector 1116 can optionally be attached to the orifice 2118. The anti-wear ring also inhibits the connector 1116 from causing the spool housing halves (1126*a* and right half) to separate.

The rotatable reel 2102 includes teeth 2120*a* spaced evenly around the circumference of an outer facing portion of the reel 2102 and teeth 2120*b* spaced evenly around the circumference of an inner facing portion of the real 2102. As shown in FIG. 8, the reel 2102 includes twelve teeth 2120*a* and twelve teeth 2120*b*, however, the reel 2102 can optionally be configured with more than twelve or less then twelve teeth. Each of the teeth 2120*a* aligns with a corresponding teeth 2120*b*. The teeth 2120*a* are adapted for engaging a first rotation inhibitor portion 2200*a* of the trigger assembly 2200. The teeth 2120*b* are adapted for engaging a second rotation inhibitor portion 2200*b* of the trigger assembly 2200. The trigger assembly 2200 rotatably mounts on a rotation axle post 2202. When assembled, a post receptor 2204 in the spool housing half 1126*a* supports the axle post 2202. A similar post receptor (not shown) located on the inner surface of the spool housing's right half also supports the rotation axle post 2202.

In operation, a user actuates the trigger assembly 2200 by depressing a trigger 2206, extending from the interior of the spool, preferably with one finger, such as the thumb. As the trigger 2206 is actuated, the rotation inhibitor portions 2200*a* and 2200*b* rotate in a clockwise direction (as shown in FIG. 8) about the trigger rotation axle post 2202. The clockwise rotation causes the first rotation inhibitor portion 2200*a* to engage one of the teeth 2120*a* and causes the second rotation inhibitor portion 2200*b* to engage a corresponding tooth 2120*b*. With the rotation inhibitor portions 2200*a* and 2200*b* engaged, the spool assembly 2100 is inhibited from extending or retracting the connector 1116. Upon release of the trigger 2200, a compression spring 2208 forces the rotation inhibitor portions 2200*a* and 2200*b* to rotate in a counter-clockwise direction about the rotation axle post 2202, thus disengaging the rotation inhibitor portions 2200*a* and 2200*b* from the teeth 2120*a* and 2120*b*, respectively. In the released position, the spool assembly 2100 is able to rotate freely to extend or retract the connector 1116. The force provided by the power spring 2104, in the absence of an external force on the connector 1116, is sufficient to retract the connector 1116 about the spool 1124. Preferably, the power spring 2104 is of sufficient bias to provide a pulling force to assist a user in various stretching exercises or a resistance force to assist in various strength training exercises.

In an alternative embodiment, the retractor can be an electromechanical retractor (not shown) in which a motor is used to retract the connector 1116 about a spool. The motor can be powered by batteries housed within the bar 1114, which can be configured as a hollow bar. Such electromechanical motors and power supplies for retracting a connector about a spool are well known in the art and a detailed description of their operation, function, or structure is not necessary for a complete understanding of the present invention.

The present invention also relates to a method of exercising that includes providing to a user an exercise device that includes a base, a bar having a spool, and a connector connecting the bar to the base, bearing against the base with the user's feet, gripping the bar, and rotating the bar to spool the connector on the spool. In use, the exercise can be conducted with the bar in front, back, or to the side of the user, or with the user standing on the base.

The various exercises that can be performed according to this method include, for example, the following: a standing forward/flexion stretch, a standing backward/extension stretch, a standing sidebend stretch, and a standing rotational stretch. To perform the various exemplary exercises, a user may be instructed as follows.

Standing Forward/Flexion Stretch.

Figure 10:
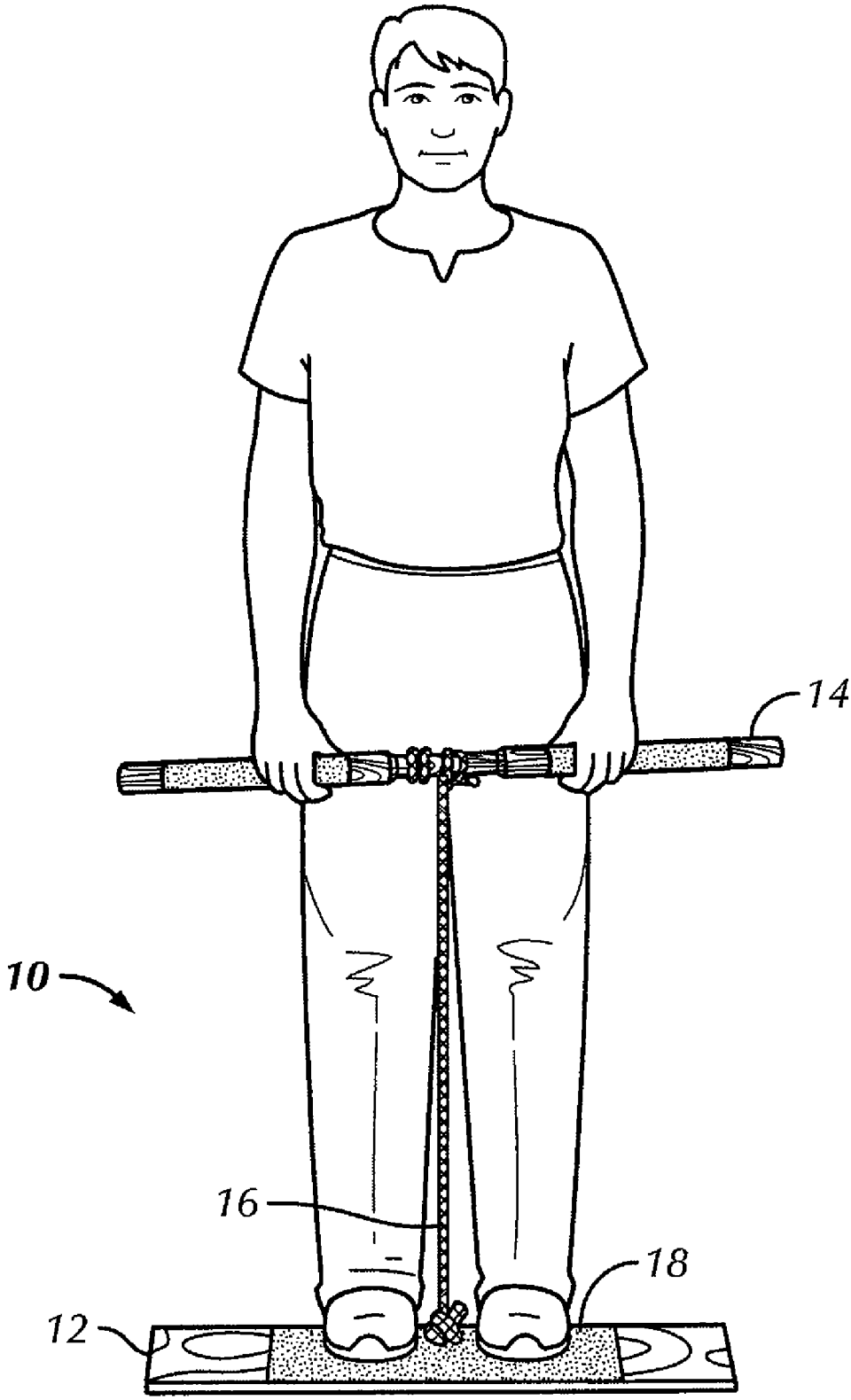
FIG. 10 is a front view of a user exercising with the exercise apparatus of FIG. 1 in accordance with another embodiment of the present invention.

Stand with feet on the base, legs straight, and hands in front as shown in FIG. 10. Grip and roll the bar as you bend at the waist to create a taut connection (e.g., with an inelastic rope connector) with the base. Gently stretch the lower back and hamstrings collecting more rope around the bar as you continue to stretch. This exercise preferably targets the lumbar spine and hamstrings.

Standing Backward/Extension Stretch.

Stand with feet on the base and hands in back. Grip and roll the bar until you have a taut connection (e.g., with an inelastic rope connector). Gently bend backwards at the hips. Gently pull on the bar until you stretch the lumbar and thoracic spine. To extenuate the exercise rotate the bar to make the connection more taut as you stretch. This exercise preferably targets the lumbar and thoracic spine.

Standing Sidebend Stretch.

For stretching the left side, stand with feet on the left side of the base. Grip the bar with your right hand along your right side and roll the bar until you have a taut connection (e.g., with an inelastic rope connector). Bend towards the right side gently pulling the torso with the bar until you stretch the left side. For stretching the left side, stand with both feet on the right side of the base. Grip the bar with your left hand along the left side and roll the bar until you have a taut connection. Bend towards your left side gently pulling the torso with the bar until you stretch the right side. To extenuate the exercise rotate the bar to make the connection more taut as you stretch. This exercise preferably targets the lumbar spine, thoracic spine, and abdominal obliques.

Standing Rotational Stretch.

Stand with feet on the base and hands in front. Grip and roll the bar until you have a taut connection (e.g., with a rope connector). Turn the torso with both hands to the right stretching the right side and then slowly rotate the torso and bar to the opposite side. Alternatively, this exercise can be conducted by turning the torso to one side and the hands to the opposite side to increase the stretch. To extenuate the exercise rotate the bar to make the connection more taut as you stretch. This exercise preferably targets the lumbar spine, thoracic spine, and abdominals.

The present invention also relates to another method of exercising that includes providing an exercise device that includes a base, a bar having a spool, and a connector connecting the bar to the base, securing the base to a user's feet, and gripping the bar. In use, the exercises can be conducted with the user on the floor lying supine (i.e., on your back), or lying prone (i.e., face down on your abdomen).

The various exercises that can be performed according to this method include, for example, the following: a sitting forward stretch, sitting calf extensions, a supine double leg hamstring stretch, a supine single leg hamstring stretch, a reverse abdominal crunch, supine leg lifts/lower abdominal lifts, a supine abdominal roll, and prone lumbar extensions. To perform the various exemplary exercises, a user may be instructed as follows.

Sitting Forward Stretch.

Sit with feet in front and in contact with the base surface. With hands in front, grip and roll the bar shortening the connection (e.g., a rope) while bending at the waist. Gently stretch and hold the position (for example, 5-10 seconds) then return to a neutral position. To provide for a deeper stretch bend the arms slightly at the elbows and gently pull the torso forward. To extenuate the exercise rotate the bar to make the connection more taut as you stretch. This exercise preferably targets the lumbar spine, hamstrings, and calf muscles.

Sitting Calf Extensions.

Sit with feet in front and in contact with the base surface. With hands in front, grip and roll the bar until the connection (e.g., a rope) is taut. Gently pull the bar back towards the waist until you stretch the calves. The feet and toes should flex slightly back towards the chin during the stretch. To extenuate the exercise rotate the bar to make the connection more taut as you stretch. This exercise preferably targets the calf muscles.

Supine Double Leg Hamstring Stretch.

Lie supine with feet in contact with the base surface and hands in front. Grip and roll the bar until the connection (e.g., a rope) is taut. Pull the bar and lift feet off the ground until you stretch the targeted muscle group i.e., hamstrings, gluteal piriformis, and pelvic accessory muscles. This exercise preferably targets the hamstrings, gluteal piriformis, and pelvic accessory muscles.

Supine Single Leg Hamstring Stretch.

Lie supine with one foot in contact with the base surface and hands in front. Grip and roll the bar until the connection (e.g., a rope) is taut. Pull on the bar and raise the foot off the ground to stretch the targeted muscle group i.e., hamstrings, gluteal piriformis, and pelvic accessory muscles. To extenuate the exercise rotate the bar to make the connection more taut as you stretch. This exercise preferably targets the hamstrings, gluteal piriformis, and pelvic accessory muscles.

Reverse Abdominal Crunch.

Lie supine with feet in contact with the base surface and hands in front. Grip and roll the bar until the connection (e.g., a rope) is taut. Pull the bar towards the chin while bending at the knees and hips. Bring the knees towards the chest and then return to a straight leg position while keeping the heels off the ground, approximately 6 inches above the ground. To extenuate the exercise rotate the bar to make the connection more taut as you stretch. This exercise preferably targets the abdominal muscles.

Supine Leg Lifts/Lower Abdominal Lifts.

Lie supine with feet in contact with the base surface and hands in front. Grip the bar in a front position parallel with the legs. Roll the bar until the connection (e.g., a rope) is taut. Lift the feet about 6-12 inches above the ground using the bar for balance. Bring the feet back down toward the floor to about 1-2 inches above the ground. Target different areas of the abdominals by adjusting the height the feet are raised above the ground. To extenuate the exercise rotate the bar to make the connection more taut as you stretch. The head can also be raised off the ground to extenuate the exercise. This exercise preferably targets the abdominal muscles.

Supine Abdominal Roll.

Lie supine with feet in contact with the base surface and hands in front. Sit forward approximately 45 degrees gripping and rolling the bar until the connection (e.g., a rope) is taut. Bend your head forward with the chin tucked into the chest and slowly roll backward raising the feet off the ground and stopping when the top of the spine (at the level of the shoulders) gently touches the ground. Roll back toward the starting position using the exercise apparatus to balance yourself so that the heels do not touch the floor (e.g., approximately 2-6 inches above the ground). To extenuate the exercise rotate the bar to make the connection more taut as you stretch. This exercise preferably targets the abdominal muscles.

Prone Lumbar Extensions.

Lie prone with feet in contact with the base surface and hands in back. Grip and roll the bar until the connection (e.g., a rope) is taut. Pull the bar and lift the feet above the ground. To extenuate the exercise rotate the bar to make the connection more taut as you stretch. Lift the head off the ground to further extenuate this exercise.

The present invention also relates to a method of exercising that includes providing to a user an exercise device that includes a base, a bar having a spool, and an elastic connector connecting the bar to the base, bearing against the base with a user's feet (e.g., by standing on the base), gripping the bar, pulling on the bar, and rotating the bar to spool the connector on the spool. In use, the exercises can be conducted with the bar in front, back, or to the side of the user.

The various exercises that can be performed according to this method include, for example, the following: bicep curls, forearm curls, standing trap pull, standing shoulder lift, standing triceps curls, bent lat pulls, and straight forearm curls. To perform the various exemplary exercises, a user may be instructed as follows.

Bicep Curls.

Stand with feet on the base and hands in front. Grip the bar with the palms of the hand facing up and roll the bar in a clockwise direction (as if viewing the user from a left side view) until the connection (e.g., an elastic band) is taut. Lift the bar in a curling motion up to the chest and then slowly curl the bar back down to the starting position. To extenuate the exercise, rotate the bar (again in the clockwise direction) as the bar is being curled up to the chest. This exercise preferably targets the biceps.

Forearm Curl.

Stand with feet on the base and hands in front. Grip and roll the bar in a counter-clockwise direction (as if viewing the user from a left side view) until the connection (e.g., an elastic band) is taut with the arms straight down in front of you and palms griped around the bar in a downward facing direction. Lift the bar in a curing motion up to the chest and then slowly curl the bar back down to the starting position. To extenuate the exercise, rotate the bar (again in the counter-clockwise direction) as the bar is being curled up to the chest. This exercise preferably targets the forearm muscle grouping.

Standing Trap Pull.

Stand with feet on the base and hands in front. Grip the bar with the palms of the hands facing in the downward direction. Roll the bar in a counter-clockwise direction (as if viewing the user from a left side view) until the connection (e.g., an elastic band) is taut at the level of the navel. Pull the bar up to the level of the chin and then return the bar to the starting position. To extenuate the exercise, rotate the bar (again in the counter-clockwise direction) as the bar is being curled up to the chin. This exercise preferably targets the trapezium, deltoids, and supporting shoulder muscles.

Standing Shoulder Lift.

Stand with feet on the base and hands in front. Roll the bar in a counter-clockwise direction (as if viewing the user from a left side view) until the connection (e.g., an elastic band) is taut and level with the chin. The arms should be bent and the palms of the hands facing upwards and at about shoulder level. Lift the bar until the arms are straight above the head. This exercise can also be done with the heals on the base and the bar in back of the user. To extenuate the exercise, rotate the bar (again in the counter-clockwise direction) as the bar is being lifted above the head. This exercise preferably targets the shoulder muscles.

Standing Triceps Curls.

Stand with heals on the base and hands in back of your head. Grip and roll the bar in a counter-clockwise direction (as if viewing the user from a left side view) until the connection (e.g., an elastic band) is taut. The arms should be bent and palms of the hands facing upwards. Lift the bar until the hands are straight above the head and then return the bar to the starting position. To extenuate the exercise, rotate the bar (again in the counter-clockwise direction) as the bar is being lifted above the head. This exercise preferably targets the triceps.

Bent Lat Pulls.

Stand with feet on the base and bent at the waist at about a 90 degree angle. With hands in front, roll the bar in a counter-clockwise direction (as if viewing the user from a left side view) with the arms straight down until the connection (e.g., elastic band) is taut. The hands should be gripped around the bar facing downward or toward the body. Lift the bar toward the chest and then return to a starting position. To extenuate the exercise, rotate the bar (again in the counter-clockwise direction) as the bar is being lifted above the head. This exercise preferably targets the latismus muscles and supporting back musculature.

Straight Forearm Curls.

Stand with feet on the base and hands in front. Grip and roll the bar with palms facing downward and arms straight in front perpendicular with the body until the connection (e.g., an elastic band) is taut. Flex the wrists backwards and then return to a neutral starting position. This exercise can also be conducted with the palms of the hands facing upwards. This exercise preferably targets the forearm muscles.

Any of the foregoing exercises can be accomplished using an elastic connector 16 that may be in the form of typical bungee cords of varying elasticity or any other elastic band capable of providing an elastic resistance that is readily known in the art.

From the foregoing description, it can be seen that the present invention provides for a novel and versatile apparatus and method of exercising. The exercise apparatus advantageously provides for a small, light weight, and inexpensive exercise tool that allows for a variety of exercises that can be used in a novel and unique way, such as by adding multi-directional and/or rotational resistances.

It will be appreciated by those skilled in the art that changes could be made to the embodiments described above without departing from the broad inventive concept thereof. For example, additional components and steps can be added to the various exercise apparatuses. It is to be understood, therefore, that this invention is not limited to the particular embodiments disclosed, but it is intended to cover modifications within the spirit and scope of the present invention as defined by the appended claims.

I claim:

1. An exercise apparatus comprising:

a base that includes:

a top plate having at least one connector retainer and at least one through-hole, at least one support bar configured with a contoured center, and a bottom plate connected to the top plate, the bottom plate having at least one support supporting the at least one support bar, wherein the contoured center of the at least one support bar protrudes through the at least one through-hole;

a bar that includes a spool; and a connector connecting the bar to the base.

2. The exercise apparatus of claim 1, wherein the base further includes:

a non-slip surface on a first surface of the base; and a fastening member connected to the first surface.

3. The exercise apparatus of claim 1, wherein the top plate includes a plurality of connector retainers.

4. The exercise apparatus of claim 1, further comprising a hand grip or an ankle strap connectable to the connector.

5. The exercise apparatus of claim 1, wherein the spool includes a retractor for retracting the connector.

6. The exercise apparatus of claim 5, wherein the retractor comprises:

an automatic spool assembly rotatably mounted inside the spool; and a trigger assembly mounted inside the spool, the trigger assembly including:

a trigger extending out of the spool; and a rotation inhibition portion for inhibiting the rotation of the automatic spool assembly.

7. The exercise apparatus of claim 1, wherein the base includes at least one strap retainer.

8. The exercise apparatus of claim 7, further comprising at least one strap connectable to the at least one strap retainer.

9. An exercise apparatus comprising a base that includes:

a top plate having at least one connector retainer and at least one through-hole;

at least one support bar configured with a contoured center; and a bottom plate connected to the top plate, the bottom plate having at least one support supporting the at least one support bar, wherein the contoured center of the at least one support bar protrudes through the at least one through-hole.

10. The exercise apparatus of claim 9, wherein the base further includes:

a non-slip surface on a first surface of the base; and a fastening member connected to the first surface.

11. The exercise apparatus of claim 9, wherein the top plate includes a plurality of connector retainers.

12. The exercise apparatus of claim 9, wherein the base includes at least one strap retainer.

13. The exercise apparatus of claim 12, further comprising at least one strap connectable to the at least one strap retainer.

14. An exercise apparatus comprising:

a base that includes:

at least one support bar configured with a contoured center extending through an opening of a top portion of the base, a non-slip surface on a first surface of the base, and a fastening member connected to the first surface;

a bar that includes a spool; and a connector connecting the bar to the base.

15. The exercise apparatus of claim 14, wherein the top portion of the base includes a plurality of connector retainers.

16. The exercise apparatus of claim 14, further comprising a hand grip or an ankle strap connectable to the connector.

17. The exercise apparatus of claim 14, wherein the spool includes a retractor for retracting the connector.

18. The exercise apparatus of claim 17, wherein the retractor comprises:

an automatic spool assembly rotatably mounted inside the spool; and a trigger assembly mounted inside the spool, the trigger assembly including:

a trigger extending out of the spool, and a rotation inhibition portion for inhibiting the rotation of the automatic spool assembly.

19. The exercise apparatus of claim 14, wherein the base includes at least one strap retainer.

20. The exercise apparatus of claim 19, further comprising at least one strap connectable to the at least one strap retainer.

* * * * *